United States Patent [19]

Wahl et al.

[11] 4,221,304

[45] Sep. 9, 1980

[54] STARTER MEANS AND METHOD FOR A POP-UP TYPE DISPENSING PACKAGING FOR INTERLEAVED PRE-MOISTENED SHEETS

[75] Inventors: Kent R. Wahl, Cincinnati, Ohio; A. Robert Harm, Sunman, Ind.

[73] Assignee: The Procter & Gamble Company, Cincinnati, Ohio

[21] Appl. No.: 951,328

[22] Filed: Oct. 16, 1978

Related U.S. Application Data

[63] Continuation of Ser. No. 780,697, Mar. 24, 1977, abandoned.

[51] Int. Cl.[2] ..... A47K 10/20

[52] U.S. Cl. ..... 221/1; 221/50

[58] Field of Search ..... 221/1, 50, 63, 48; 118/43

[56] References Cited

U.S. PATENT DOCUMENTS 2,158,712 5/1939 West ..... 221/50 X 3,994,417 11/1976 Boedecker ..... 221/63

*Primary Examiner*—Stanley H. Tollberg

*Attorney, Agent, or Firm*—Frost & Jacobs

[57] ABSTRACT

Starter sheet and method for a pop-up type dispensing package for individual product sheets, arranged in an interleaved stack or in a perforated web. The package is of the type having a restrictive dispensing orifice so sized that the topmost product sheet cannot be conveniently grasped by the consumer through the dispensing orifice. The starter sheet is less porous than the product sheets. The starter sheet is interleaved with and overlies the topmost product sheet of a stack thereof or is interleaved with or attached to the first product sheet of a perforated web thereof. During the packaging process a vacuum is applied to the dispensing orifice or directly to the starter sheet through the dispensing orifice to draw a sufficient portion of the starter sheet through the dispensing orifice to enable withdrawal of the starter sheet, bringing the topmost product sheet into its pop-up position ready for withdrawal.

26 Claims, 6 Drawing Figures

STARTER MEANS AND METHOD FOR A POP-UP TYPE DISPENSING PACKAGING FOR INTERLEAVED PRE-MOISTENED SHEETS

REFERENCE TO RELATED APPLICATION

This application is a continuation of application Ser. No. 780,697 filed Mar. 24, 1977, in the name of the same inventors and entitled "STARTER MEANS AND METHOD FOR A POP-UP TYPE DISPENSING PACKAGE FOR INTERLEAVED PRE-MOISTENED SHEETS", now abandoned.

BACKGROUND OF THE INVENTION

1. Field of the Invention

The invention relates to starter means and a method for a pop-up type dispensing package for a sheet product, the package having a restrictive dispensing orifice, and more particularly to a starter sheet and the drawing of the starter sheet by vacuum means part way through the package dispensing orifice so that it may be conveniently withdrawn from the dispensing orifice bringing the topmost product sheet to its pop-up position.

2. Description of the Prior Art

The starter means and method of the present invention are applicable to a pop-up type dispensing package for product sheets, the package having a restrictive dispensing orifice. As used herein and in the claims the phrase "restrictive dispensing orifice" refers to a dispensing orifice of such size that the topmost product sheet cannot be conveniently grasped by the consumer through the dispensing orifice. For purposes of an exemplary showing the starter means and method of the present invention will be described as applied to a package of the type taught in U.S. Pat. No. 4,138,034, issued Feb. 6, 1979 in the name of Robert F. McCarthy.

Briefly, the above mentioned U.S. Pat. No. 4,138,034 teaches a moisture-proof package of discrete, interleaved, pre-moistened product sheets, the package being provided with a dispensing opening so dimensioned as to enable twice the cross sectional area of a pre-moistened product sheet (i.e. two pre-moistened product sheets in tightly gathered form) to pass therethrough without such undue friction as would cause the product sheets to jam, tear or separate before the next succeeding product sheet is presented for subsequent removal. The succeeding product sheet not only is presented for subsequent removal, but also serves in the meantime as a plug for the dispensing opening, minimizing evaporation of the volatile composition with which the product sheets have been pre-moistened and preventing contamination of the remaining product sheets within the package. No additional closure or lid is required to be closed by the consumer to prevent dry-out or contamination.

The above noted copending application teaches that the topmost product sheet of the stack may be partially inserted through the dispensing orifice through the use of a mandrel or the like during the packaging process, obviating the necessity for the consumer to open the package and start the first sheet through the dispensing opening (as required in numerous prior art packages). This, in turn, eliminates the risk of contaminating the contents, spilling the product sheets or disturbing their interleaved condition.

The present invention provides an improved means for consumers to start the topmost product sheet through the small dispensing orifice without disturbing the contents of the package. In accordance with the teachings of the present application, a starter sheet is provided, the starter sheet being less porous than the product sheets. The starter sheet is interleaved with and overlies the topmost product sheet and may be drawn part way through the dispensing orifice by vacuum means. The starter sheet of the present invention not only serves as an easy means for the consumer to start the topmost product sheet through the dispensing orifice, but also provides temporary protection against product evaporation or contamination. In addition, the starter sheet may serve as a disposable marketing message or advertising device. The ability to draw the starter sheet part way through the dispensing orifice by vacuum greatly simplifies the packaging equipment which would otherwise have to be provided with mandrel means or the like.

While the package of the above mentioned U.S. Pat. No. 4,138,034, is an excellent example of a pop-up dispensing package with a restrictive dispensing orifice, it will be understood by one skilled in the art that the present invention is not restricted to use with the particular package taught or to use with pre-moistened sheets. The present invention is applicable to many types of pop-up dispensing packages for product sheets wherein the package has a restrictive dispensing orifice too small to permit the consumer to conveniently start the topmost product sheet therethrough by reaching therethrough with his fingers.

SUMMARY OF THE INVENTION

The present invention is directed to an improved means and method for starting the topmost product sheet through a restrictive dispensing orifice of a sheet-containing package. In an exemplary embodiment the product sheets are pre-moistened with a volatile component and the package is of the type comprising a container impervious to the volatile component. The sheets are discrete and arranged in an interleaved stack. The top surface of the container has a restrictive dispensing orifice therein so sized as to just permit the passage therethrough of two pre-moistened product sheets in tightly gathered form resulting in pop-up dispensing of the product sheets, each sheet serving, until its removal from the package, as a plug for the dispensing orifice to minimize evaporation of the volatile component with which the product sheets are pre-moistened and to protect the remaining sheets within the package from contamination.

In accordance with the teachings of the present invention, a starter sheet is interleaved with and overlies the topmost product sheet of the stack. During the packaging process, the starter sheet is partially drawn through the dispensing orifice by vacuum to the extent that it may be readily grasped by the consumer for removal from the package, drawing the topmost product sheet into its pop-up position. The starter sheet is less porous than the product sheets so that only a portion of the starter sheet is drawn through the dispensing orifice. The starter sheet may indeed be non-porous, if desired.

The product sheets need not be pre-moistened and need not be arranged in an interleaved stack. The teachings of the present invention may also be applied to a package containing a continuous perforated web of sheets folded into a stack or wound into a roll. In such instances the first sheet of the web (if of appropriate thickness, strength and flexibility may be treated to be non-porous or less porous than the remaining product sheets and may serve as a starter sheet. Alternatively a starter sheet may be interleaved with or appropriately attached to the first product sheet of the web.

DESCRIPTION OF THE PREFERRED EMBODIMENTS

As indicated above, the starter means and method of the present invention are applicable to many types of containers for an interleaved stack of sheets wherein the dispensing orifice is too small for the consumer to grasp the topmost product sheet through the dispensing orifice. For purposes of an exemplary showing, the invention will first be described in its application to a package for pre-moistened sheets of the type taught and illustrated in the above mentioned U.S. Pat. No. 4,138,034.

The nature of the pre-moistened sheets to be dispensed does not constitute a limitation on the present invention. The sheets may be made of paper, nonwoven cloth, woven cloth, film or the like. The sheets may be pre-moistened with any appropriate volatile composition. The package may be made of rigid or semi-rigid plastic, paper board laminates, combinations of paper board and film or paper board and rigid or semi-rigid plastics, or the like. The material from which the package is made will depend upon the nature of the volatile component with which the sheets are pre-moistened and should be compatible therewith and impervious thereto.

Figure 1:
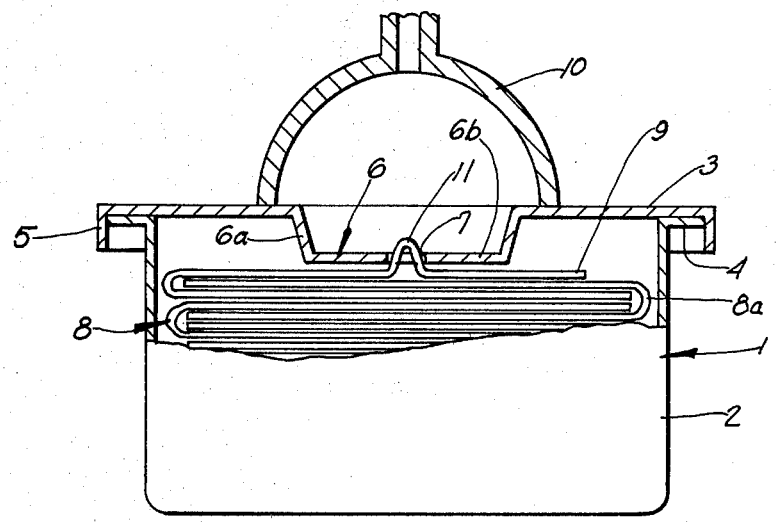
FIG. 1 is an elevational view, partly in cross section, of an exemplary package containing an interleaved stack of pre-moistened product sheets and further illustrating a starter sheet being drawn through the package dispensing orifice by vacuum means.

An exemplary package is illustrated in FIGS. 1 through 4. Turning first to FIG. 1, the package is generally indicated at 1 and comprises a rectangular tray 2 and a cover member 3. The tray 2 has about its upper edge a laterally extending peripheral flange 4. The cover 3 is provided with a downwardly depending peripheral flange 5 and is so sized as to just nicely receive the flange 4 of tray 2. Once a stack of sheets has been located within the tray 2, the cover 3 will be located thereon and will be heat, adhesively or mechanically sealed to the tray flange 4, depending upon the nature of the material from which the tray 2 and cover 3 are molded.

The upper surface of cover 3 may have a depression (generally indicated at 6) formed therein. When provided, the configuration of the depression 6 does not constitute a limitation. For purposes of an exemplary showing, the depression is illustrated as being circular with an annular inwardly and downwardly sloping wall 6*a* and a substantially planar bottom 6*b*.

A dispensing orifice 7 is located in the bottom 6*b* of depression 6. The dispensing orifice may be of any appropriate configuration although it is preferred that the dispensing orifice be circular or oval. As is taught in the above mentioned U.S. Pat. No. 4,138,034, the size of the dispensing orifice 7 is critical. The orifice should be so sized as to permit twice the cross sectional area of a pre-moistened product sheet (i.e. two pre-moistened product sheets in tightly gathered form) to pass therethrough. It will be understood that this refers to the cross sectional area of the product sheet being extracted from the package and of the next succeeding product sheet being pulled to pop-up position. The dispensing orifice 7 should be so sized that the force required to pull a tightly gathered double thickness of the product sheets therethrough is not so great as to be inconvenient to the consumer. The tightly gathered double thickness of the product sheets should pass through the orifice 7 without such undue friction as would cause the sheets to jam, tear or as would cause the sheets to separate until the sheet being extracted has cleared the orifice. Thus, the orifice size will be selected to achieve maximum restriction and still maintain easy dispensing, depending on the orifice wall texture, the texture of the pre-moistened product sheets and the lubricating properties of the volatile compound with which the product sheets are pre-moistened. It will be evident from the above that the orifice 7 will be of a size such that the consumer could not pull the topmost product sheet therethrough with his fingers.

In the use of a package of the type just described, when a given product sheet is extracted from orifice 7, a sufficient amount of the next succeeding product sheet will be drawn through the orifice so that it may conveniently be grasped and extracted by the consumer at a later time. Thus, the orifice 7 permits pop-up dispensing of discrete product sheets. In addition, that portion of each product sheet which is pulled through the orifice 7 in gathered form by the previously extracted product sheet will serve as a plug for the orifice, minimizing dry-out and/or contamination of the remainder of the product sheets within the tray 2 without necessitating an additional resealable flap, hinged cover or plug-type closure for the package. Thus, the package 1 provides a means for reliably dispensing individual wet product sheets while protecting the reserve product sheets from evaporation of the volatile composition with which they have been premoistened.

Heretofor, in dispensing packages having small dispensing orifices, it was common practice in the prior art to provide the package with a primary top containing the dispensing orifice and a secondary reclosable lid for the dispensing orifice. The consuumer was required to remove the primary top and thread the topmost portion of the product through the dispensing orifice, replacing the primary lid or top on the package. This approach has a number of disadvantages. First of all, it is inconvenient for the consumer. It also involves the risk of contaminating the package contents and, when the contents constitute interleaved product sheets, there is also the risk of spilling the stack of product sheets or disturbing their interleaved condition.

The above mentioned U.S. Pat. No. 4,138,034, teaches that the topmost product sheet may be started through dispensing orifice 7 by mandrel means or the like prior to the application of the cover 3 to tray 2. While this is advantageous for the consumer and eliminates the above mentioned problems, it renders a high speed packaging process more complex, requiring more complicated packaging equipment. The starter means and method of the present invention not only eliminate the prior art problems faced by the consumer, but also lend themselves well to a high speed packaging process without requiring complex packaging machinery.

Returning to FIG. 1, a stack of interleaved product sheets is generally indicated at 8. It will be understood that, for purposes of an exemplary showing, the thickness of the interleaved product sheets is greatly exaggerated and hence their number is reduced. The topmost product sheet is shown at 8*a*. In accordance with the present invention, interleaved with and overlying the topmost product sheet 8*a* there is a starter sheet 9. The starter sheet 9 is a non-product, sheet. During the packaging process, the stack of interleaved product sheets 8 including starter sheet 9 (interleaved with and overlying the topmost product sheet 8*a*) is located in the tray 2. The cover 3 is thereafter placed upon the tray and sealed thereto by heat sealing, adhesive sealing or mechanical sealing, as described above.

A vacuum head 10 of any appropriate and well known type is placed in contact with the cover 3, as shown in FIG. 1. This may be done before or after the sealing of cover 3 to the tray 2. It will be understood that the vacuum head is connected to a source of vacuum (not shown). The vacuum head should be at least large enough to surround and encompass dispensing orifice 7. For purposes of an exemplary showing, the vacuum head 10 is illustrated as having a diameter sufficient to surround the entire depression 6 in the cover 3. A vacuum is in this fashion applied to orifice 7 drawing the starter sheet 9 upwardly through dispensing orifice 7. In FIG. 1 starter sheet 9 is illustrated just as it is beginning to be drawn through dispensing orifice 7, as at 11. The starter sheet should be less porous than the product sheets so that when a vacuum is applied to dispensing orifice 7 only the starter sheet is drawn therethrough. If the starter sheet is of the same porosity as the product sheets, the first one or more product sheets may also be drawn upwardly by the vacuum preventing the starter sheet from being drawn through the restrictive dispensing orifice 7. While not required, the starter sheet may indeed be non-porous.

Figure 2:
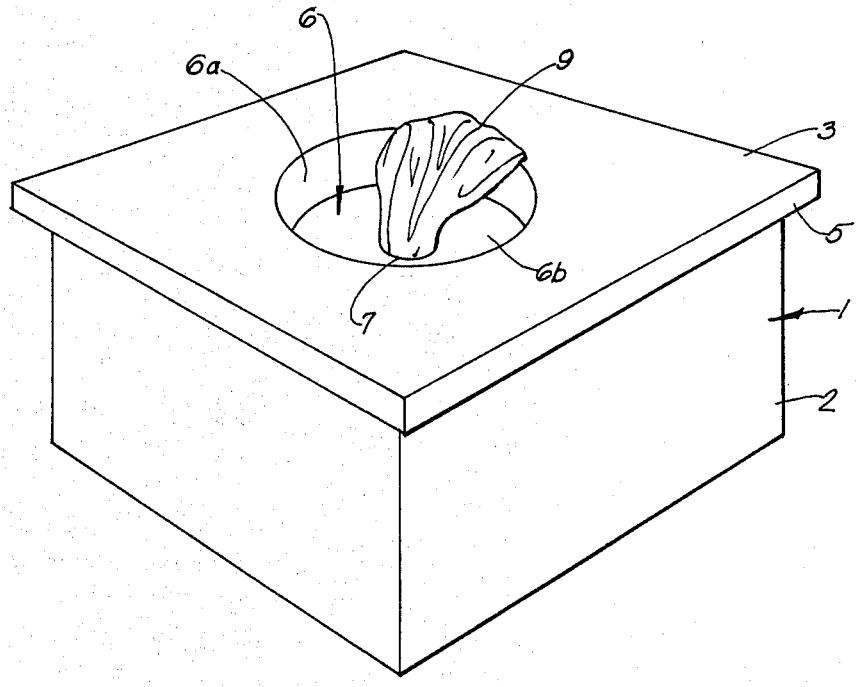
FIG. 2 is a perspective view of the package of FIG. 1 illustrating the starter sheet in position to be grasped by the consumer.
Figure 3:
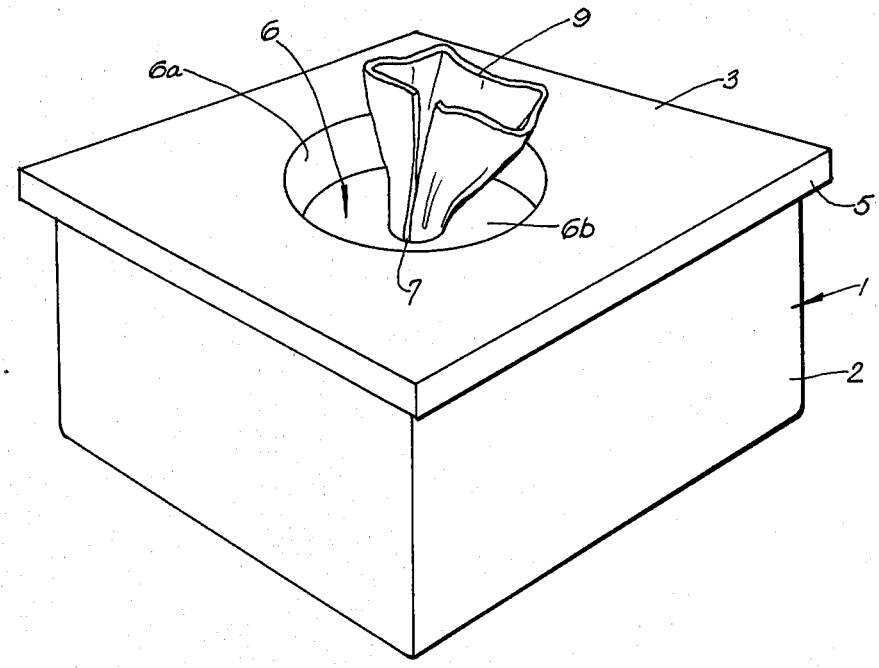
FIG. 3 is a perspective view similar to FIG. 2 and illustrating the starter sheet in position to be grasped by the consumer, the starter sheet having been drawn through the dispensing orifice to an extent that its leading edge has been withdrawn from the package.
Figure 4:
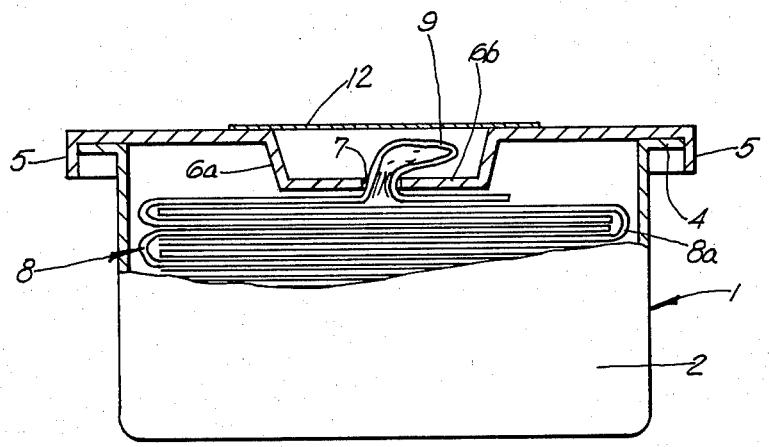
FIG. 4 is an elevational view, partly in cross section, and showing the starter sheet in position to be grasped by the consumer and covered by a detachable and discardable barrier layer or seal.

The starter sheet 9 need only be drawn through dispensing orifice 7 by an amount sufficient to enable the starter sheet to be grasped by the consumer. While this amount may be readily varied, in general if the starter sheet protrudes through dispensing orifice 7 by about $\frac{1}{2}$ to $\frac{3}{4}$ of an inch, the starter sheet may be easily removed by the consumer from packages of the type shown in FIGS. 1 through 4. Removal of starter sheet 9 will draw the topmost product sheet 8*a* to its pop-up position. FIG. 2, wherein like parts have been given like reference numerals, shows the starter sheet 9 drawn through the dispensing orifice 7 to form an easily graspable "bubble," the leading edge of the starter sheet still located within the package 1. In instances where it is desired to have a greater amount of the starter sheet extending through dispensing orifice 7, the leading edge of the starter sheet will be drawn through the dispensing orifice. This is shown in FIG. 3, wherein like parts have again been given like reference numerals. In FIG. 3 the thickness of starter sheet 9 has again been exaggerated for purposes of clarity. It will be evident from FIGS. 2 and 3 that starter sheet 9, itself, will serve as a plug for dispensing orifice 7 until such time as the starter sheet is removed by the consumer.

Starter sheet 9 may be made of any appropriate material such as plastic, cloth or paper which is either inherently less porous or treated to be less porous than the product sheets. Again, the starter sheet may inherently be or may be treated to be non-porous. The starter sheet must be compatible with the volatile component with which the product sheets are premoistened. The starter sheet must be sufficiently strong and flexible to enable it to be drawn through dispensing orifice 7 by vacuum and to draw the topmost product sheet 8*a* through the dispensing orifice 7 upon its withdrawal from the package by the consumer.

It will be understood that if the starter sheet 9 is too stiff or thick, it will not properly draw through dispensing orifice 7. On the other hand, if starter sheet 9 is too thin, it may be ruptured by the vacuum or it may fail to pull the topmost product sheet 8*a* through the dispensing orifice 7 when withdrawn by the consumer.

The choice of an appropriate starter sheet 9 is well within the skill of the worker in the art. As a nonlimiting example, excellent results were achieved with a package of the type illustrated in FIG. 1 wherein the cover 3 had a circular dispensing orifice 7 with a 3/16 inch diameter (i.e. an opening area of 0.0276 square inch). The product sheets were of nonwoven rayon 2.5 inches wide and 0.005 inch thick (i.e., a cross sectional area of 0.0125 square inch), two sheets having a total cross sectional area of 0.025 square inch). The volatile compound with which the sheets were pre-moistened was a light oil. The sheets were extracted through the dispensing orifice in the machine direction of the sheets. In this example, a polyethylene starter sheet was used. The polyethylene starter sheet was of substantially the same length and width dimensions as the product sheets and had a thickness of 1 mil. The starter sheet was drawn part way through the dispensing orifice by a vacuum at a pressure of 20 inches of mercury. In such an example, a polyethylene starter sheet having any appropriate thickness (so long as it is sufficiently flexible to enable it to be drawn through orifice 7) will perform well.

It will be understood by one skilled in the art that starter sheet 9 may also bear printed indicia such as advertising, a marketing message or the like. Preferably, the package will be provided with a detachable and discardable barrier layer or seal adhesively affixed to the cover 3 and overlying the depression 6 and the dispensing orifice 7. Such a barrier layer or seal is shown at 12 in FIG. 4 (wherein like parts have been given like reference numerals) and is described in the above mentioned U.S. Pat. No. 4,138,034. The package 1 may also be provided with a partial or complete overwrap, or the package itself may be located within an outer carton such as a full flap paper board carton or the like. These elements, of course, do not constitute a part of the present invention.

The teachings of the present invention are directed to packages having a restrictive dispensing orifice as defined above. The orifice need not be of the specific type taught in the above mentioned U.S. Pat. No. 4,138,034.

Furthermore, the teachings of the present invention are not limited to an interleaved stack of sheets or to sheets which have been pre-moistened with a volatile component.

Figure 5:
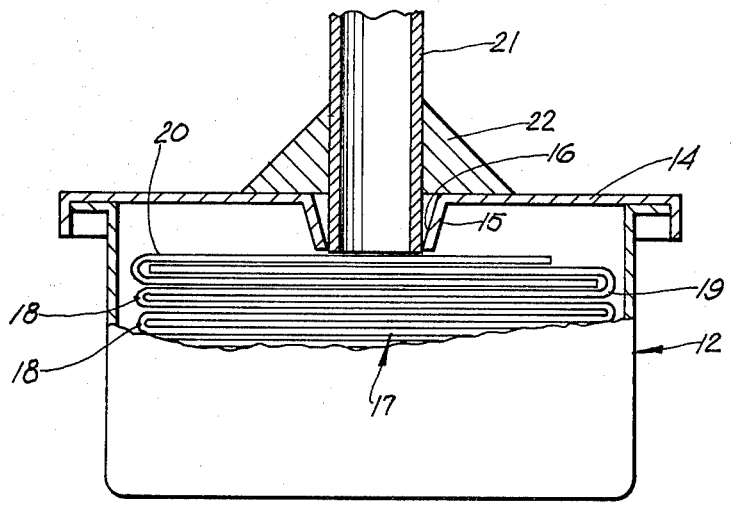
FIG. 5 is a fragmentary elevational view, partly in cross section, illustrating another embodiment of the present invention.

Reference is now made to FIG. 5 wherein another embodiment of the present invention is illustrated. In FIG. 5 a package is generally indicated at 12. For purposes of an exemplary showing, the package comprises a tray-like portion 13 and a cover 14. The package 12 is again intended to dispense sheets in a pop-up manner.

The nature of the dispensing orifice is not limiting other than that it is of such size that the consumer could not conveniently start the topmost product sheet through the dispensing orifice with his fingers. In an exemplary showing the cover 14 is illustrated as having a downwardly and inwardly sloping portion 15 defining a dispensing orifice 16. It will be noted that while the dispensing orifice 16 is still restrictive as defined above, it is larger than the dispensing orifice 7 of FIGS. 1 through 4.

The container 12 is illustrated as being provided with a plurality of product sheets in the form of a continuous, folded, perforated web, generally indicated at 17. The precise manner of folding and the location of the lines of perforation in the web are not necessarily limiting. In the exemplary embodiment, the sheets of the web are shown provided with a V-fold with lines of perforation indicated at 18. The topmost sheet of the continuous web 17 is shown at 19. Interleaved therewith is a starter sheet 20 which is identical to the starter sheet 9 of FIG. 1. Again it will be understood that the thickness of the starter sheet 20 and the individual sheets of the web 17 is exaggerated for purposes of clarity.

The starter sheet 20 serves the same function as starter sheet 9 of FIG. 1 and operates in the same way. The starter sheet 20 may be partially drawn through dispensing orifice 16 by a vacuum head similar to that shown at 10 in FIG. 1. Since, in the embodiment shown in FIG. 5 the dispensing orifice 16 is larger than the dispensing orifice 7 of FIG. 1, it would also be possible to provide a vacuum head or tube 21 so sized as to be insertable through dispensing orifice 16 and placed near or in contact with starter sheet 20. The vacuum head or tube 21 may be provided with stop means 22 to limit the depth to which it extends into package 12 through the dispensing orifice 16. Upon the application of a vacuum, the starter sheet may be held in contact with the vacuum tube 21 and drawn through the dispensing orifice 16 by retraction of vacuum tube 21.

Further modifications may be made in the embodiment of FIG. 5 as will be evident from that Figure. For example, the starter sheet 20 need not necessarily be interleaved with the topmost produce sheet of the web 17. The starter sheet 20 may be so sized as to overlie the topmost product sheet 19 and may have its trailing edge appropriately adhered to or attached to the leading edge of the topmost product sheet 19.

It will also be evident from FIG. 5 that if the material from which the sheets of web 17 are made is of sufficient strength and flexibility, the starter sheet 20 could be eliminated and the first sheet 19 of the web could be pre-treated to be non-porous or less porous than the remaining product sheets. Under these circumstances, the first sheet of the web 17 would, itself, serve as the starter sheet.

Figure 6:
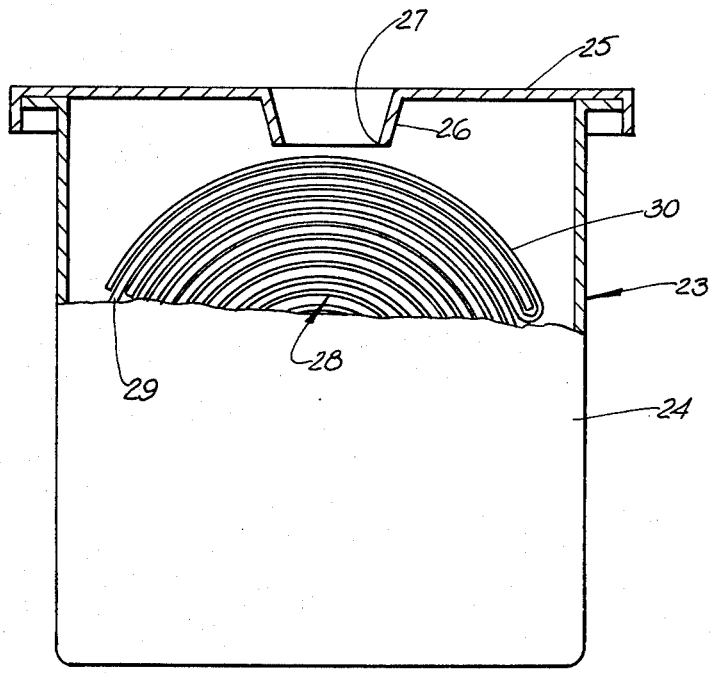
FIG. 6 is a fragmentary elevational view, partly in cross section, illustrating yet another embodiment of the present invention.

FIG. 6 illustrates yet another embodiment of the present invention. The package of FIG. 6 is generally indicated at 23 and comprises a tray-like portion 24 and a cover 25. The cover 25 may, for purposes of description, be substantially identical to the cover 14 of FIG. 5. To this end, it is illustrated as having a downwardly and inwardly extending flange 26 defining a dispensing opening 27. The tray-like portion 24 is configured to accommodate a continuous perforated web of sheets in roll form. The rolled web of sheets is generally indicated at 28.

The first product sheet of the rolled web 28 is shown at 29. Interleaved therewith is a starter sheet 30 which may be identical to starter sheet 20 of FIG. 5 or starter sheet 9 of FIG. 1.

Although the product sheets are in the form of a continuous roll web 28 in the embodiment of FIG. 6, rather than in an interleaved stack such as stack 8 of FIG. 1 or a continuously folded web such as the web 17 of FIG. 5, the function of starter sheet 30 is identical to that described with respect to starter sheet 9 of FIG. 1 or starter sheet 20 of FIG. 5. The starter sheet 30 may be partially drawn through the dispensing orifice 27 by vacuum means either of the type shown at 10 in FIG. 1 or of the type shown at 21 in FIG. 5.

As described with respect to FIG. 5, it will be evident that the starter sheet 30 need not necessarily be interleaved with the first product sheet 29 of web 28. The starter sheet 30 may have its trailing edge appropriately affixed to or adhered to the leading edge of first product sheet 29.

Again, when the web 28 is made of material having appropriate strength and flexibility, the starter sheet 30 could be eliminated and the first sheet 29 of the web could be pre-treated so as to be non-porous (or less porous than the remaining product sheets), so as to serve, itself, as the starter sheet.

Modifications may be made in the invention without departing from the spirit of it. For example, the package 1 of FIG. 1 could be provided with a continuous, folded, perforated web of the type shown at 17 in FIG. 5 or with a continuous, perforated, rolled web of the type shown at 28 in FIG. 6.

In the application of a vacuum to draw the starter sheet through the dispensing orifice, after the manner described with respect to FIG. 1, it has been found that if this step is performed prior to the sealing of the cover 3 to the flange 4 of tray 2, with the cover 3 resting upon the flange 4 or spaced slightly upwardly therefrom, the vacuum step can be performed rapidly and the distance between the dispensing orifice 7 and the starter sheet 9 is not critical. On the otherhand, if this vacuum step is performed after sealing the cover 3 to the tray 2, the vacuum step requires that the starter sheet preferably be in relatively close proximity to the dispensing orifice 7 either by virtue of the height of the stack or, alternatively, by virtue of the flexibility of the materials from which the package 1 is made such that the dispensing orifice 7 and the starter sheet 9 may be brought into relatively close proximity under the loading of the vacuum head to permit such withdrawal.

Finally, althought the invention has been described in terms of the starter sheet being withdrawn through the dispensing orifice by the consumer, it is within the scope of the present invention to have the starter sheet withdrawn as a part of the packaging process so that the consumer is presented with the topmost product sheet in its pop-up position.

The embodiments of the invention in which an exclusive property or privilege is claimed are defined as follows:

1. A starting means for a pop-up type dispensing package for product sheets, said package having a restrictive dispensing orifice of such size that a consumer could not grasp the first one of said product sheets through said dispensing orifice with his fingers, said starter means comprising a starter sheet arranged with the first one of said product sheets to be dispensed in such a manner that withdrawal of said starter sheet from said restrictive dispensing orifice will cause said first product sheet to assume its pop-up position therethrough, said package comprising a tray-like portion to receive said product sheets and said starter sheet and a cover for said tray-like portion to close said tray-like portion and to overlie said starter sheet, said restrictive dispensing orifice being located in said cover, a portion of said starter sheet extending through said restrictive dispensing orifice, said last mentioned portion of said starter sheet being of sufficient length as to be conveniently grasped by the fingers of the consumer, said starter sheet being sufficiently less porous than said product sheets and of such strength and flexibility that said portion thereof may be drawn through said restrictive dispensing orifice by vacuum without withdrawing a portion of said first product sheet therethrough.

2. The structure claimed in claim 1 wherein said starter sheet is of substantially the same length and width dimensions as said product sheets.

3. The structure claimed in claim 1 wherein said starter sheet is interleaved with said first product sheet.

4. The structure claimed in claim 1 wherein the trailing end of said starter sheet is attached to the leading end of said first product sheet.

5. The structure claimed in claim 1 wherein said starter sheet is non-porous.

6. The structure claimed in claim 1 wherein said product sheets are arranged in an interleaved stack.

7. The structure claimed in claim 1 wherein said product sheets comprise a continuous perforated web folded into a stack.

8. The structure claimed in claim 1 wherein said product sheets comprise a continuous perforated web in roll form.

9. The structure claimed in claim 6 wherein said product sheets are pre-moistened with a volatile component and wherein said restrictive dispensing orifice is so dimensioned as to just permit two of said pre-moistened sheets in tightly gathered form to be manually drawn therethrough.

10. The structure claimed in claim 9 wherein said starter sheet is interleaved with said first product sheet.

11. The structure claimed in claim 10 wherein said starter sheet is of substantially the same length and width dimensions as said product sheets.

12. The structure claimed in claim 10 wherein said starter sheet comprises a polyethylene sheet.

13. A method of providing starter means for a pop-up type dispensing package containing a plurality of product sheets and having a restrictive dispensing orifice sized such that a consumer could not grasp the first one of said product sheets through said dispensing orifice with his fingers, said method comprising the steps of providing a starter sheet less porous than said product sheets, arranging said starter sheet with the first one of said product sheets so that withdrawal of said starter sheet from said restrictive orifice will cause said first product sheet to assume its pop-up position therethrough, locating said product sheets and said starter sheet in said package and drawing by vacuum means a sufficient amount of said starter sheet through said restrictive dispensing orifice to be conveniently grasped by the fingers of the consumer.

14. The method claimed in claim 13 including the steps of inserting said vacuum, means through said restrictive dispensing orifice, drawing a vacuum through said vacuum means to draw said starter sheet thereagainst, withdrawing said vacuum means from said restrictive dispensing orifice to pull said amount of said starter sheet therethrough and releasing said vacuum to release said starter sheet from said vacuum means.

15. The method claimed in claim 13 including the step of interleaving said starter sheet with said first product sheet.

16. The method claimed in claim 13 including the step of attaching the trailing end of said starter sheet to the leading end of said first product sheet.

17. The method claimed in claim 13 where said product sheets are arranged in an interleaved stack.

18. The method claimed in claim 13 wherein said product sheets comprise a continuous perforated web folded into a stack.

19. The method claimed in claim 13 wherein said product sheets comprise a continuous perforated web in roll form.

20. The method claimed in claim 13 wherein said package comprises a tray-like portion to receive said product sheets and said starter sheet and a cover for said tray-like portion to close said tray-like portion and to overlie said starter sheet, said restrictive dispensing orifice being located in said cover.

21. The method claimed in claim 13 wherein said starter sheet is non-porous.

22. The method claimed in claim 20 where said product sheets are arranged in an interleaved stack.

23. The method claimed in claim 22 wherein said product sheets are pre-moistened with a volatile component and wherein said restrictive dispensing orifice is so dimensioned as to just permit two of said pre-moistened sheets in tightly gathered form to be manually drawn therethrough.

24. The method claimed in claim 22 wherein said starter sheet is of substantially the same length and width dimensions as said product sheets.

25. The method claimed in claim 22 wherein said starter sheet comprises a polyethylene sheet.

26. A method of providing starter means for a pop-up type dispensing package containing a plurality of product sheets and having a restrictive dispensing orifice sized such that a consumer could not grasp the first one of said product sheets through said dispensing orifice with his fingers, said method comprising the steps of providing a starter sheet less porous than said product sheets, arranging said starter sheet with the first one of said product sheets so that withdrawal of said starter sheet from said restrictive orifice will cause said first product sheet to assume its pop-up position therethrough, locating said product sheets and said starter sheet in said package, applying a vacuum means to the exterior of said package about said restrictive dispensing orifice and drawing a vacuum through said vacuum means for a sufficient time to pull said starter sheet through said restrictive dispensing orifice by a sufficient amount to enable the starter sheet to be conveniently grasped by the fingers of the consumer.

* * * * *